United States Patent [19]

Johnson

[11] 4,416,403

[45] Nov. 22, 1983

[54] CHILD CARRYING BACK PACK

[76] Inventor: Allan H. Johnson, Im Haeldele 52, 7634 Kippenheim, Fed. Rep. of Germany

[21] Appl. No.: 264,848

[22] Filed: May 18, 1981

[30] Foreign Application Priority Data

Jun. 3, 1980 [CA] Canada ..... 353272

[51] Int. Cl.[3] ..... A45F 3/00

[52] U.S. Cl. ..... 224/161; 224/262; 224/159

[58] Field of Search ..... 224/151, 153, 155, 156, 224/157, 261, 263, 161

[56] References Cited

U.S. PATENT DOCUMENTS

| | | | |
|---|---|---|---|
| 3,097,773 | 7/1963 | Cummingham | 224/161 |
| 3,260,428 | 7/1966 | Mack | 224/161 |
| 3,282,483 | 11/1966 | Babcock | 224/263 X |
| 3,421,670 | 1/1969 | Hansson | 224/161 |
| 3,610,489 | 5/1971 | Parsons | 224/161 |
| 3,713,568 | 1/1973 | Sloan | 224/161 |
| 3,774,824 | 11/1973 | Hansson | 224/161 |
| 3,799,414 | 2/1974 | Fiffer | 224/161 |
| 3,827,612 | 8/1974 | Mead et al. | 224/263 |
| 3,968,910 | 7/1976 | Dye et al. | 224/161 |

*Primary Examiner*—Steven M. Pollard
*Assistant Examiner*—David Voorhees
*Attorney, Agent, or Firm*—Larson and Taylor

[57] ABSTRACT

A carrier is adapted to be worn by an adult to secure in place a child seated upon the adult's shoulders while leaving the arms of the adult free. The carrier has a frame with a pair of interconnected upright side members to be laterally spaced behind and projecting upwardly of the shoulders of the adult. A flexible back restraint attached to these frame members defines a retaining web which in use is spaced behind the head of the adult and supports the back and seat of the child. Front restraint means is attached to each of frame members and secures the child against movement out of the carrier in the forwards direction. A lower support includes a belt adapted to be strapped to the body and supported on the hips of the adult. A thrust support interconnects the frame to the belt. The retaining web has a bottom portion from which extend a pair of laterally spaced length-adjustable shoulder straps to extend over the front of the adult's shoulders and be attached to the lower support.

5 Claims, 5 Drawing Figures

CHILD CARRYING BACK PACK

FIELD OF THE INVENTION

This invention relates to a new or improved child carrying back pack.

DESCRIPTION OF THE PRIOR ART

Numerous arrangements have been proposed in the past to provide a device which will enable an infant to be carried by an adult while leaving the adult's hands and arms free. Examples of such devices are shown in Canadian Patent Nos. 803,341 and 849,914. In such arrangements, the child is tied to the bearer's back by shoulder straps. The weight of the child is thus placed somewhat behind the bearer's shoulders so that to maintain balance the bearer must assume a stance which is slightly forwardly stooped. This becomes very tiring if the child is to be carried for extended lengths of time. This problem is avoided to some extent in other known arrangements as shown in U.S. Pat. Nos. 3,698,608 and 3,968,910 which show arrangements in which the child is carried on the shoulders of the bearer. However in these arrangements the entire weight of the child is supported upon the bearer's shoulders.

SUMMARY OF THE INVENTION

The present invention provides a carrier adapted to be worn by an adult to secure in place a child seated upon the adult's shoulders, comprising: upper support means including: frame means having a pair of interconnected side members adapted to be laterally spaced in an upright orientation behind and projecting upwardly of the shoulders of the adult; flexible back restraint means attached to said frame members to define a retaining web which in use is spaced behind the head of the adult and supports the back and seat of the child; and front restraint means attached to each of said frame members and adapted to secure the child against movement out of said carrier in the forwards direction; lower support means comprising a belt adapted to be strapped to the body and supported on the hips of the adult; and a thrust support interconnecting the frame means to said belt; said retaining web having a bottom portion from which extend a pair of laterally spaced length-adjustable shoulder straps adapted to extend over the front of the adult's shoulders and be attached to said lower support means.

With this arrangement the child is supported directly above the shoulders of the adult, so that the attitude of the adult does not have to be changed to support an unbalanced load. Furthermore, the weight of the child is distributed between the shoulders and hips of the adult, so that use of the carrier is less tiring to the adult than would be the case with a carrier wherein the entire weight of the child is applied to the adult's shoulders. Preferably the carrier includes means for adjusting the length of the thrust support so that the distribution of the weight of the child between the shoulders and hips of the adult can be adjusted to ensure minimum discomfort for the adult.

The front restraint means adds to the safety to the carrier, since it helps to secure the child in place. Preferably the front restraint means is in the form of a pair of length adjustable restraint straps attached to the upper ends of the side members, crossing over behind the head of the adult, and attached to the lower support means. Therefore these restraint straps can also serve to hold the frame means firmly against the shoulder blades of the adult, and thus prevent the centre of gravity of the supported load from being displaced to the rear.

Preferably the thrust support is provided by arranging for the side members to extend continuously down to the level of the belt. The length adjustment may be achieved simply by a telescopic arrangement of these extended side members. The extended side members may be interconnected by rearwardly bowed transverse frame members, pivotally interconnected so that the carrier may be moved from an extended position of use to a collapsed position wherein the vertical frame members lie alongside one another, and the over-all bulk of the carrier is reduced to a very compact form.

BRIEF DESCRIPTION OF THE DRAWINGS

The invention will further be described, by way of example only, with reference to the accompanying drawings, wherein.

DESCRIPTION OF THE PREFERRED EMBODIMENT

Figure 1:
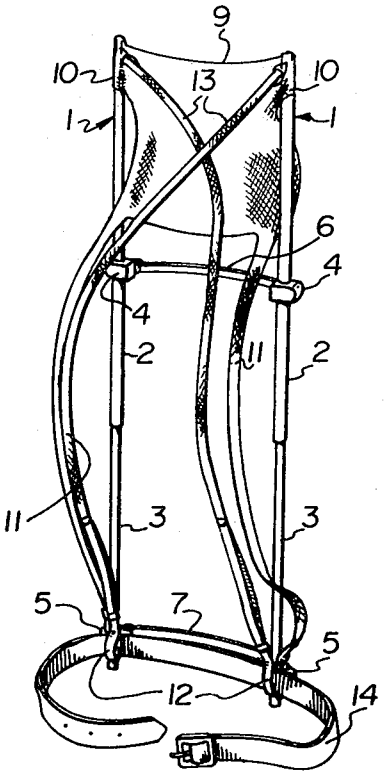
FIG. 1 is a perspective view of a carrier in accordance with the invention.

As shown, the carrier comprises a pair of parallel upright frame members 1. The frame members 1 include upper and lower tubular aluminum sections 2 and 3 respectively, telescopically arranged so as to be relatively adjustable vertically to vary the length of the frame member. Locking means (not shown) are provided for selectively locking the sections 1 and 2 in a desired position of adjustment. Each frame member section 1,2 has attached thereto upper and lower brackets 4 and 5 respectively. Pivotally connected between the upper brackets 4 is an upper transverse frame member 6, and pivotally connected between the lower brackets 5 is a lower transverse frame member 7. The brackets 4,5 and transverse frame members 6,7 are fabricated as plastics moldings. Each transverse frame member of 6,7 is of bowed configuration as seen in plan view having a rearwardly bowed central section.

Figure 2:
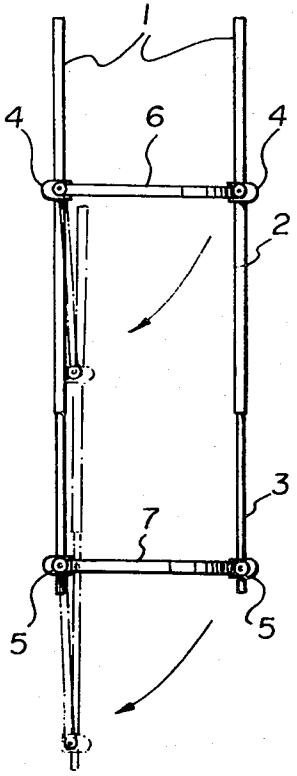
FIG. 2 is a front view of the carrier frame.

From the foregoing it will be clear that the upright frame members 1 and the transverse frame members 6 and 7 form a parallelogram frame structure as shown in FIG. 2. By virtue of the pivotal mounting of the transverse frame members 6 and 7, it will be appreciated that the frame can be moved from an extended position, as shown in full lines in FIG. 2, wherein the upright frame members 1 are laterally spaced and the transverse frame members 6,7 extend at right angles thereto, to a folded or collapsed condition, as shown in broken lines in FIG. 2, wherein the upright frame members 1 and 2 lie alongside and closely adjacent one another.

Disposed between the upper sections of the upright frame members 1 above the upper transverse frame member 6 is a flexible back restraint webbing 9 the opposite sides of which are secured to the tops of the frame members 1, as by being provided with sewn tubular pockets 10 adapted to receive the tops of the frame members 1. The back restraint webbing 9 may be of a suitable material such as canvas or nylon or the like, and has extending from its lower edge a pair of laterally spaced shoulder straps 11. The shoulder straps 11 as shown are length adjustable, and have lower ends anchored to eyes attached to the lower ends of the respective frame members 1.

A pair of front restraint straps 13 are also provided. Each of these has an upper end connected to the pocket 10, and its lower end detachably connected to the lower end of the opposite upright frame member 1, so that these straps are crossed over between the frame members. The straps 13 are length adjustable, and are releasably connected at their lower ends to the frame members 1. A belt 14 is provided at the lower end of the carrier, being threaded through the eyes 12 carried at the bottom of the upright frame members 1, so as to form a lower support means for the carrier when in use.

When readied for use, the carrier is disposed substantially in the configuration as shown in FIG. 1, except that the lower ends of the front restraint straps 13 are detached from their eyes, and moved to the side to allow ready access to the carrier.

The carrier is then put on by the adult who passes his arms between the respective shoulder straps 11 and frame members 1. With the frame members 1 adjusted to the desired length, the adult straps the belt 14 securely to his hips.

Figure 4:
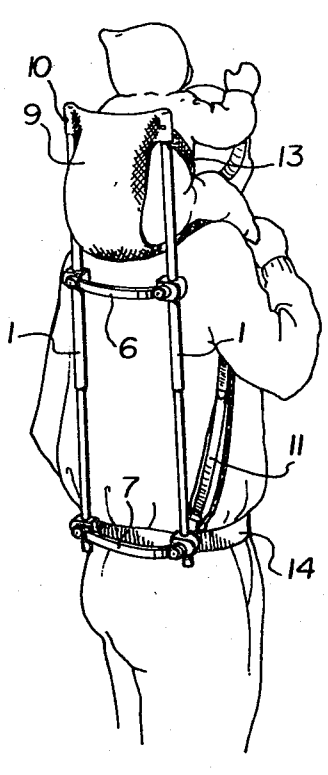
FIG. 4 is a rear perspective view of the carrier when in use.

The child to be carried may now be lifted over the adult's head and lowered into the carrier to the position shown in FIG. 4 of the drawings. The back and seat of the child in this position are securely supported by the back restraint webbing 9, the shoulder straps 11 being adjusted in length to achieve the most comfortable position.

The front restraint straps 13 are then crossed over in front of the child (substantially in the position as shown in FIG. 1) and fastened at their lower ends to the eyes 12. These straps are then adjusted in length both to provide a secure restraint for the child against being displaced forwardly out of the carrier, and also to draw the frame forwards against the back of the adult to balance the load of the child and ensure that its centre of gravity is not displaced too far to the rear.

It will be appreciated that the configuration of the lower end of the frame forms a thrust support by means of which part of the weight of the child can be applied to the hips of the adult. Thus the child's weight is distributed between the shoulders and hips of the adult, which is of course less tiring than if all of the weight were borne upon the shoulders. By suitable adjustment of the length of the frame members 1 and of the shoulder and front restraint straps, the weight distribution can be adjusted until the most comfortable position is found. The rearwardly bowed configuration of the transverse frame members 6 and 7 prevents interference of these members with the body of the adult when the carrier is in use.

Figure 3:
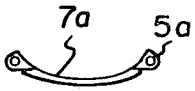
FIG. 3 is a plan view of a modified cross member for the carrier frame.
Figure 5:
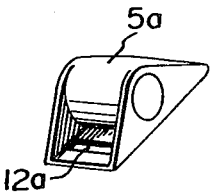
FIG. 5 is an enlarged perspective view of the end bracket of the cross member of FIG. 3.

The various frame members can, of course, be fabricated in any suitable material. FIGS. 3 and 5 show a presently preferred configuration of the lower transverse frame member and its end brackets. As shown in these figures, the lower frame member *7a* is of moulded plastics construction, and also are the lower brackets *5a*. The latter can be pivotally attached to the ends of the frame member *7a* through pop rivets (not shown) or by any other suitable means. An eye *12a* to receive the belt 14 can be formed integrally in the bracket *5a*.

Furthermore, it will be apparent that various alternative arrangements may be selected for attachment of the straps 11 and 13. In one alternative (not shown) the front restraint straps 13 are provided by a continuous cord which has a central section threaded through the upper edge of the back restraint webbing 9. At each of the webbing 9 the cord is looped into a tubular plug inserted in the upper end of the upper frame section 2. The cord loop passes around and is retained by a wedge pin located at the lower end of the plug.

Various other modifications will be apparent to those skilled in the art, and all such are intended to be embraced within the scope of the invention, as delimited by the appended claims.

What is claimed is:

1. A carrier adapted to be worn by an adult to secure in place a child seated upon the adult's shoulders, comprising: upper support means including: frame means having a pair of interconnected side frame members adapted to be laterally spaced in an upright orientation behind and projecting upwardly of the shoulders of the adult; flexible back restraint means attached to said side frame members to define a retaining web which in use is spaced behind the head of the adult and supports the back and seat of the child; and front restraint means attached to each of said side frame members and adapted to secure the child against movement out of said carrier in the forwards direction; lower support means comprising a belt adapted to be strapped to the body and supported on the hips of the adult; a thrust support interconnecting the frame means to said belt said thrust support being formed by downwardly extended lower ends of said side frame members; said retaining web having a bottom portion from which extend a pair of laterally spaced length-adjustable shoulder straps adapted to extend over the front of the adult's shoulders and be attached to said lower support means; and a pair of transverse frame members interconnecting said side frame members at spaced locations in their length, the opposite ends of said transverse frame members being pivotally interconnected to the respective side frame members to form a parallelogram linkage which is movable between an extended condition wherein the side frame members are spaced apart and a collapsed condition wherein the side frame members lie adjacent each other.

2. A carrier according to claim 1 wherein the lower of said transverse frame members is at the bottom of said side frame members and carries loops through which said belt is passed.

3. A carrier according to claim 1 wherein said front restraint means comprises a pair of length-adjustable restraint straps each attached at one end to a respective one of said side frame members and at its other end to the lower support means, such that in use said restraint straps cross over one another in front of the child and behind the head of the adult, and serve also to hold the frame means against the shoulder blades.

4. A carrier according to claim 1, 2, or 3 wherein each of said transverse frame members is bowed rearwardly between its ends to avoid interference with the back of the adult.

5. A carrier according to claim 1 or 2 including means for adjusting the length of said thrust support to distribute the weight of the child between the shoulders and hips of the adult.

* * * * *